US012514348B2

(12) United States Patent
Liu

(10) Patent No.: US 12,514,348 B2
(45) Date of Patent: Jan. 6, 2026

(54) HANDLE FOR A WALKING ASSISTANCE DEVICE

(71) Applicant: HOMECARE ENTERPRISE CO., LTD., Changhua (TW)

(72) Inventor: Shih-Chieh Liu, Changhua (TW)

(73) Assignee: HOMECARE ENTERPRISE CO., LTD., Changhua County (TW)

( * ) Notice: Subject to any disclaimer, the term of this patent is extended or adjusted under 35 U.S.C. 154(b) by 202 days.

(21) Appl. No.: 18/513,612

(22) Filed: Nov. 19, 2023

(65) Prior Publication Data

US 2025/0160490 A1 May 22, 2025

(51) Int. Cl.
*A45B 9/02* (2006.01)

(52) U.S. Cl.
CPC ..... *A45B 9/02* (2013.01)

(58) Field of Classification Search
CPC ..... A45B 9/02; A63C 11/222
See application file for complete search history.

(56) References Cited

U.S. PATENT DOCUMENTS 766,605 A * 8/1904 Dilg ..... A47B 57/56 108/106
1,054,026 A * 2/1913 Person ..... A45B 17/00 135/74
3,738,674 A * 6/1973 Pauls ..... A61H 3/0288 135/70
3,948,535 A * 4/1976 Negi ..... A63C 11/221 403/93
4,121,605 A * 10/1978 Schmerl ..... A45B 9/00 135/65
4,402,529 A * 9/1983 Cavazza ..... A63C 11/22 280/821
4,597,589 A * 7/1986 Fujii ..... A63C 11/222 280/821
5,337,771 A * 8/1994 Berges ..... A45B 9/02 135/25.4
6,491,323 B1 * 12/2002 Kustritz ..... A63C 11/222 280/821
6,644,328 B1 * 11/2003 Lenhart ..... A63C 11/222 52/72
7,445,016 B1 * 11/2008 Ortiz ..... A45B 9/02 135/65
10,028,556 B2 * 7/2018 Monk ..... A45B 9/02
2010/0154850 A1 * 6/2010 Schulz ..... A45B 9/02 135/65

* cited by examiner

*Primary Examiner* — Noah Chandler Hawk

(57) ABSTRACT

The handle for a walking assistance device includes: a connecting joint, a handle member and a switching rod. The handle member is rotatably installed between the connecting joint and the two trunnions, and utilizes the switching rod and the first and second positioning slot of the two trunnions to achieve the positioning state of the handle member after swinging. Therefore, the connecting joint can adjust the angle of the handle member according to the usage status, so that it is suitable for the support use of general walking sticks and the assistive walking use of trekking poles both, which greatly improves the practicality and convenience of the structure, while saving the cost of purchasing crutches with different functions.

4 Claims, 8 Drawing Sheets

A-A

HANDLE FOR A WALKING ASSISTANCE DEVICE

BACKGROUND OF THE INVENTION

Field of the Invention

The present invention relates to a handle structure with drawers and more particularly to a handle for a walking assistance device.

Description of the Related Art

Walking assistance devices function like the third foot (or even the fourth foot) of human beings, assisting the user to stand and walk. The weight of the body is transferred to the assistance devices through the hands, thereby reducing the weight and pressure exerted on the legs. It can also increase the stability to maintain the body's balance on uneven roads.

The main structure of a common crutch is a straight and hard stick body and a crutch head connected to the stick body for the user to hold. One end of the stick body is in contact with the ground, and the weight of the body is supported on the crutch to disperse pressure on legs and knees. Similar to the use of crutches, there are also trekking poles, which are provided for mountain climbers and hikers to easily complete the journey. However, apart from the difference in the bottom pads of the above-mentioned crutches and trekking poles, the most obvious difference is in the holding method and angle of the handle. The handle of crutches is usually L-shaped or T-shaped parallel to the ground, and the handle of trekking poles is is upright and forms a vertical shape with the ground. Due to different use environments and support effects, users with related activities must purchase two different walking assistance device with different functions to cope with different needs.

Therefore, it is desirable to provide a handle for a walking assistance device to mitigate and/or obviate the aforementioned problems.

SUMMARY OF INVENTION

An objective of present invention is to provide a handle for a walking assistance device, which is capable of improving the above-mention problems.

In order to achieve the above mentioned objective, the handle for a walking assistance device includes: a connecting joint, a handle member and a switching rod. The handle member is rotatably installed between the connecting joint and the two trunnions, and utilizes the switching rod and the first and second positioning slot of the two trunnions to achieve the positioning state of the handle member after swinging. Therefore, the connecting joint can adjust the angle of the handle member according to the usage status, so that it is suitable for the support use of general walking sticks and the assistive walking use of trekking poles both, which greatly improves the practicality and convenience of the structure, while saving the cost of purchasing crutches with different functions.

Other objects, advantages, and novel features of invention will become more apparent from the following detailed description when taken in conjunction with the accompanying drawings.

DETAILED DESCRIPTION OF PREFERRED EMBODIMENT

Figure 1:
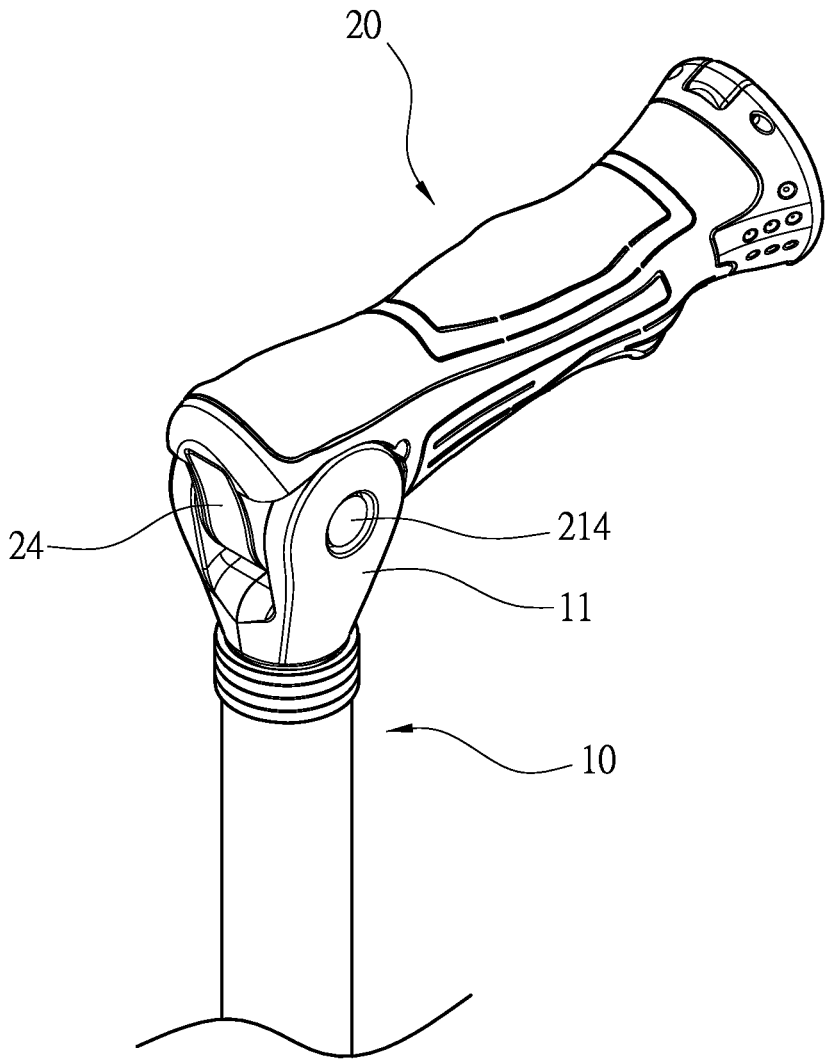
FIG. 1 is a three-dimensional view according to a preferred embodiment of the present invention.
Figure 2:
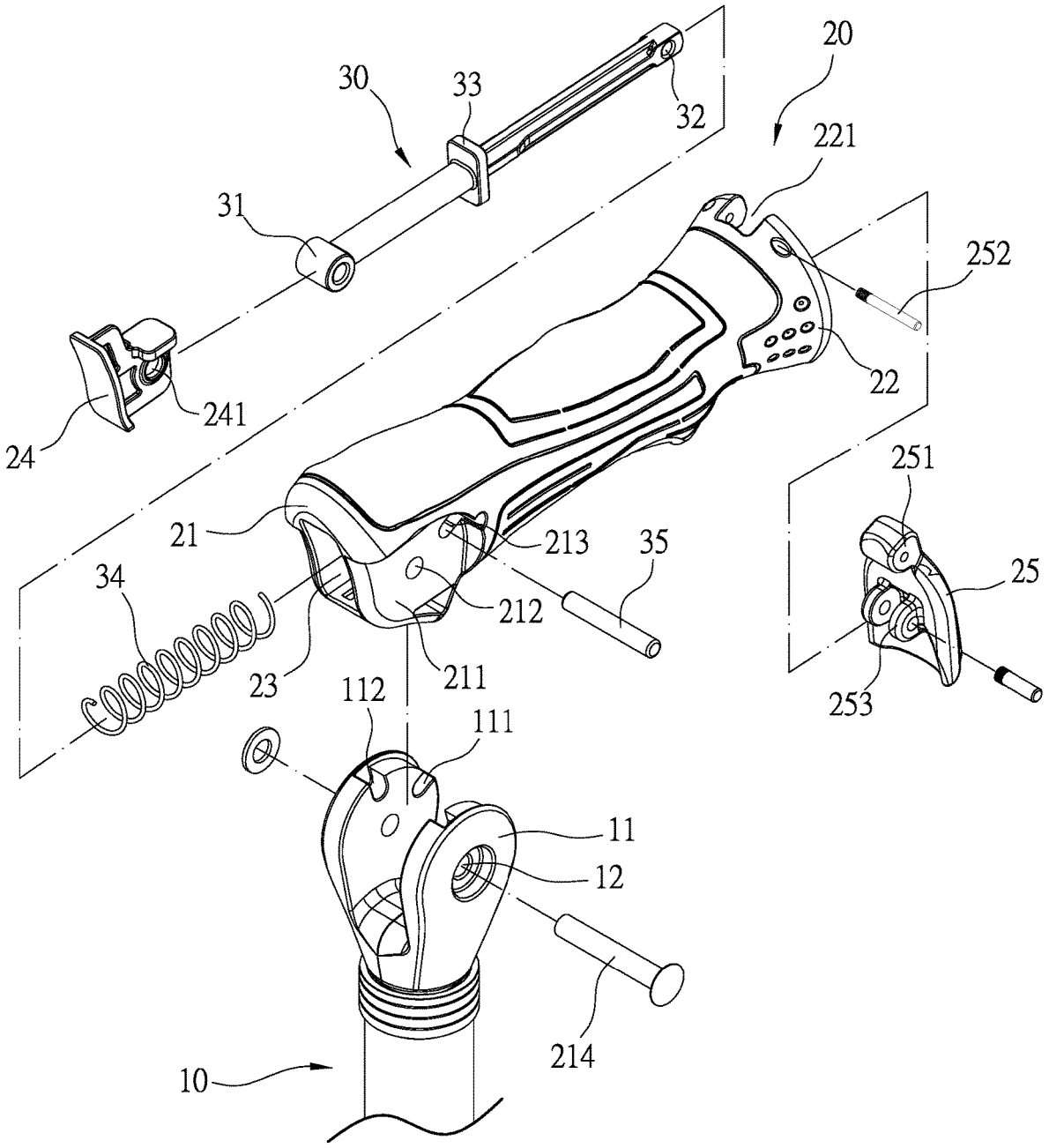
FIG. 2 is an exploded view according to the preferred embodiment of the present invention.
Figure 3:
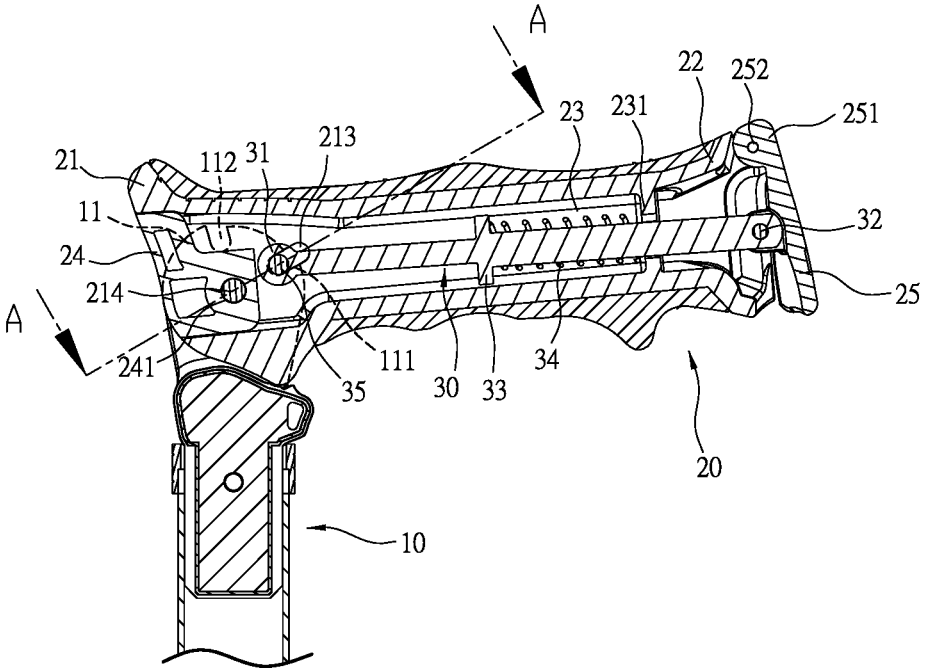
FIG. 3 is a combined cross-sectional view according to the preferred embodiment of the present invention.

First, please refer to FIGS. 1, 2 and 3, a handle for a walking assistance device comprises: a connecting joint 10, a handle member 20 and a switching rod 30. The connecting joint 10 with an end having a pair of trunnions 11, the two trunnions 11 both respectively having an axial hole 12 and a first positioning slot 111 and a second positioning slot 112. The handle member 20 has a first end 21, a second end 22 and a chamber 23 in between the first and second end 21, 22, and the first end 21 has two matching recesses 211 opposite to each other and corresponding to the two trunnions 11 and having an axial aperture 212 and a switching groove 213 connected the chamber 23. The axial aperture 212 is equipped with a shaft pin 214 to be pivoted with the axial holes 12 of the two trunnions 11. The first end 21 of the handle member 20 further comprises a tube plug 24 inserted into the chamber 23, and the tube plug 34 further comprises a through aperture 241 capable of being aligned with the axial aperture 212 and secured by the shaft pin 214. The second end 22 has a rotatable cover 25 and a pivoting recess 221 disposed at an edge of the chamber 23. The cover 25 further comprises a pivoting protrusion 251 at one end configured for engagement with the pivoting recess 221 and secured together by a shaft 252. The cover 25 further has an assembling portion 253, and the chamber 23 has an annular divider 231 adjacent to the second end 22. The switching rod 30 has a first connecting end 31 and a second connecting end 32, and a stopping block 33 between the first and second connecting ends 31, 32. The the second connecting end 32 of the switching rod 30 is jacketed with a spring 34 and insertable into the chamber 23 from the first end 21 of the handle member 20. The second connecting end 32 passes through the annular divider 231 and is connected to the assembling portion 253 of the cover 25, and the second connecting end 32 limits the spring 34 between the annular divider 231 and the stopping block 33. The first connecting end 31 faces the switching groove 213 and is connected to the first connecting end 31 by utilizing a plug 35 inserted through the switching groove 213, such that the switching rod 30 controls movement of the plug along 35 the switching groove 213 via movement of the cover 25.

For structure assembly, as shown in FIG. 1-4, the switching rod 30 is installed in the chamber 23 of the handle member 20, the second connecting end 32 passes the annular divider 231 and is connected to the assembling portion 253 of the cover 25, the spring 34 is disposed between the annular divider 231 and the stopping block 33, the first connecting end 31 of the switching rod 30 faces the switching groove 213, and the plug 35 passes through the switching groove to be connected to the first connecting end 31, such that the first connecting end 31 utilizes the plug 35 to move along the switching groove 213. With the movement of the cover 25 and the elasticity of the spring 34, the first end 21 of the handle member 20 is installed between the two trunnions 11 of the connecting joint 10. The two matching recesses 211 of the first end 21 correspondingly engage with and between the two trunnions 11, and the shaft pin 214 connects the axial hole 12 and the axial aperture 212, such that the first end 21 is capable of rotating around the shaft pin 214 and the switching groove 213 faces the first positioning slot 111 or the second positioning slot 112, and two ends of the plug 35 protrude from the switching groove 213 which complete the engagement of the plug 35 and the first and second positioning slot 111, 112.

Figure 4:
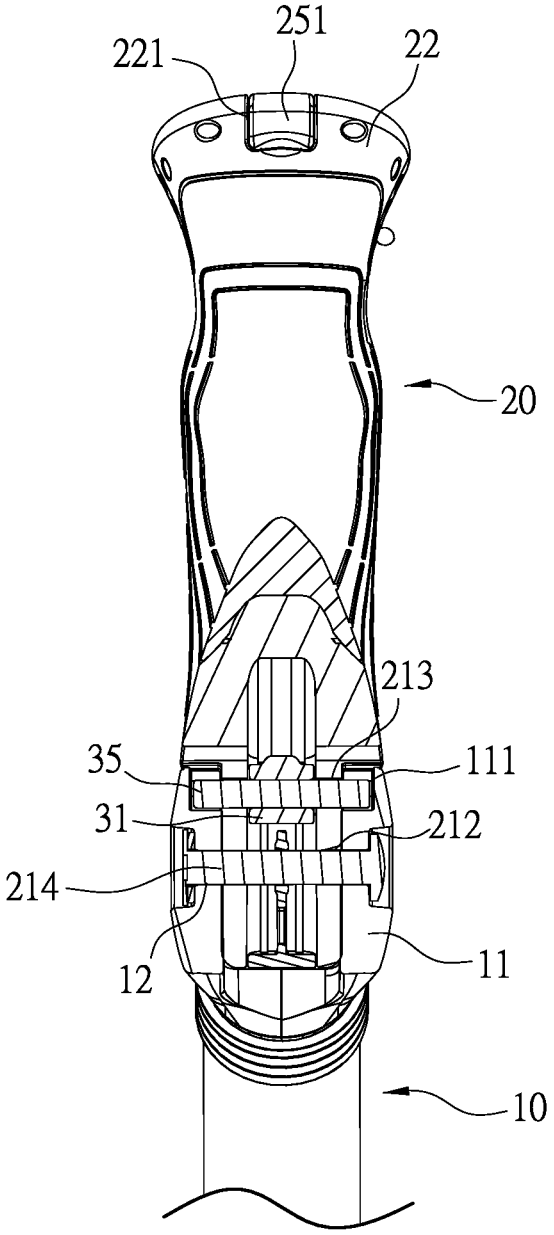
FIG. 4 is a cross-sectional view along the line A-A in FIG. 3 according to the preferred embodiment of the present invention.
Figure 5:
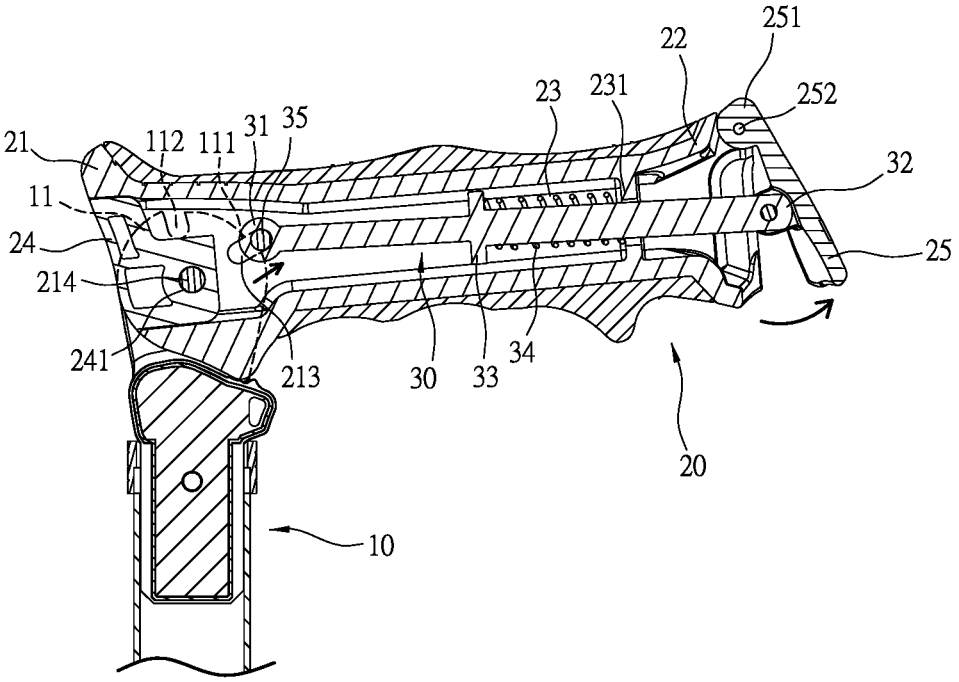
FIG. 5 is a schematic drawing showing the handle member being released from its positioning state after the cover being pushed according to the preferred embodiment of the present invention.
Figure 6:
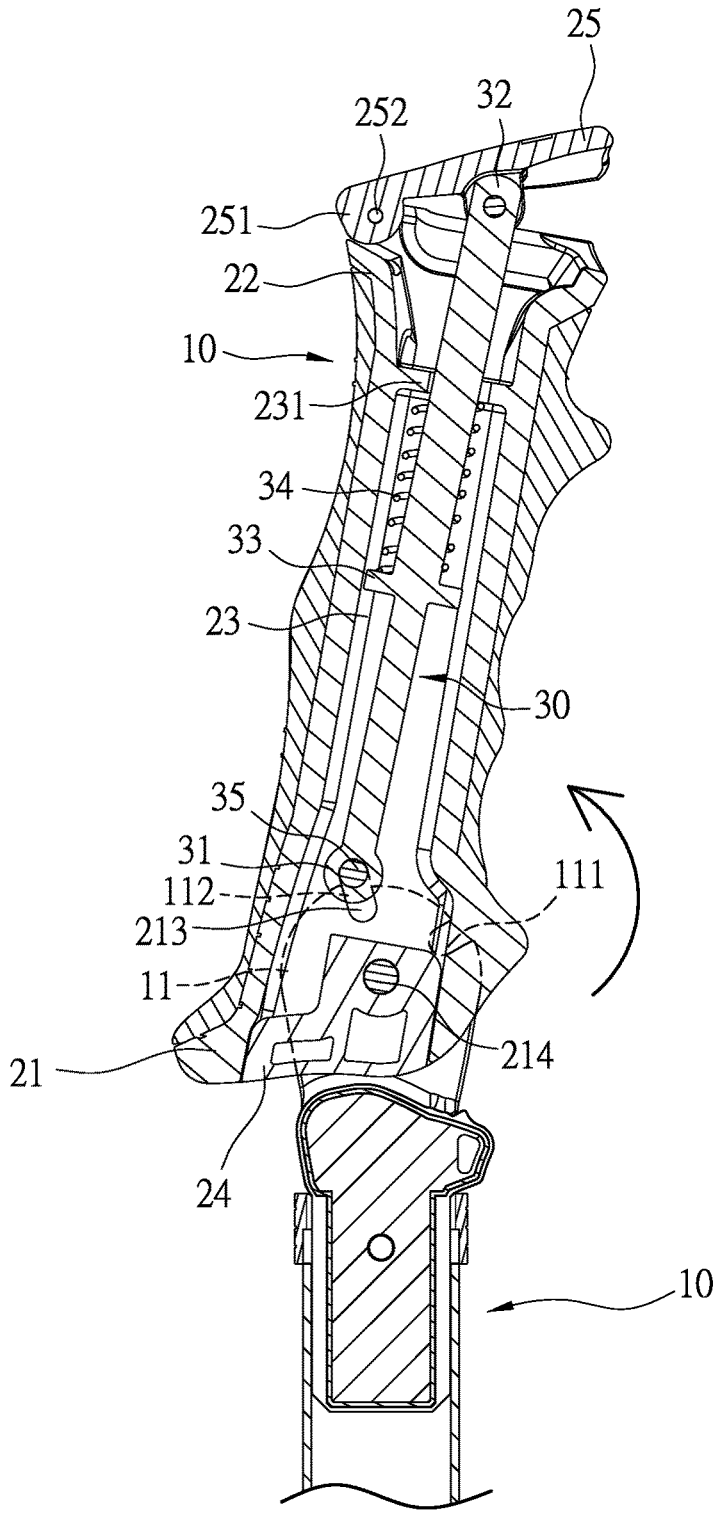
FIG. 6 is a schematic drawing showing the upward swinging action of the handle member according to the preferred embodiment of the present invention.
Figure 7:
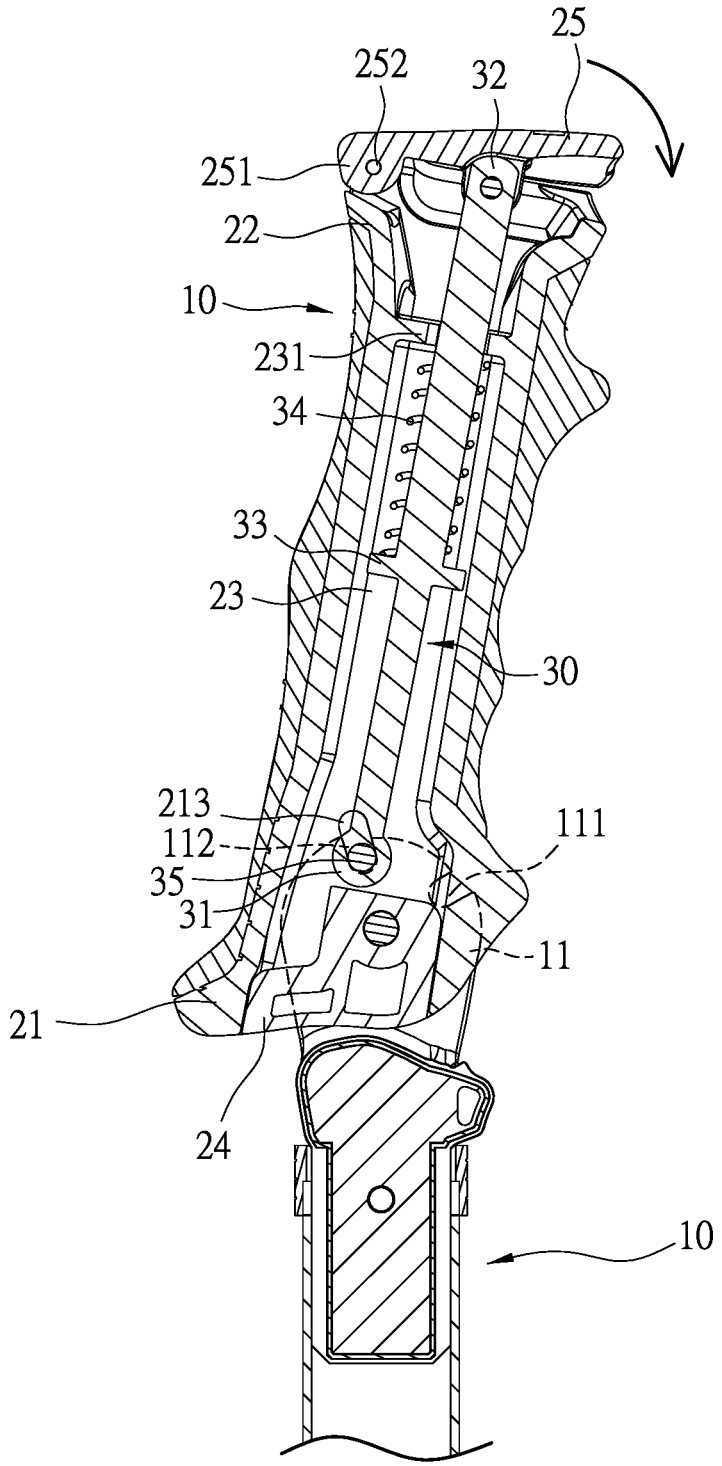
FIG. 7 is a schematic drawing showing the handle member rebounding and positioning due to the release of the cover according to the preferred embodiment of the present invention.
Figure 8:
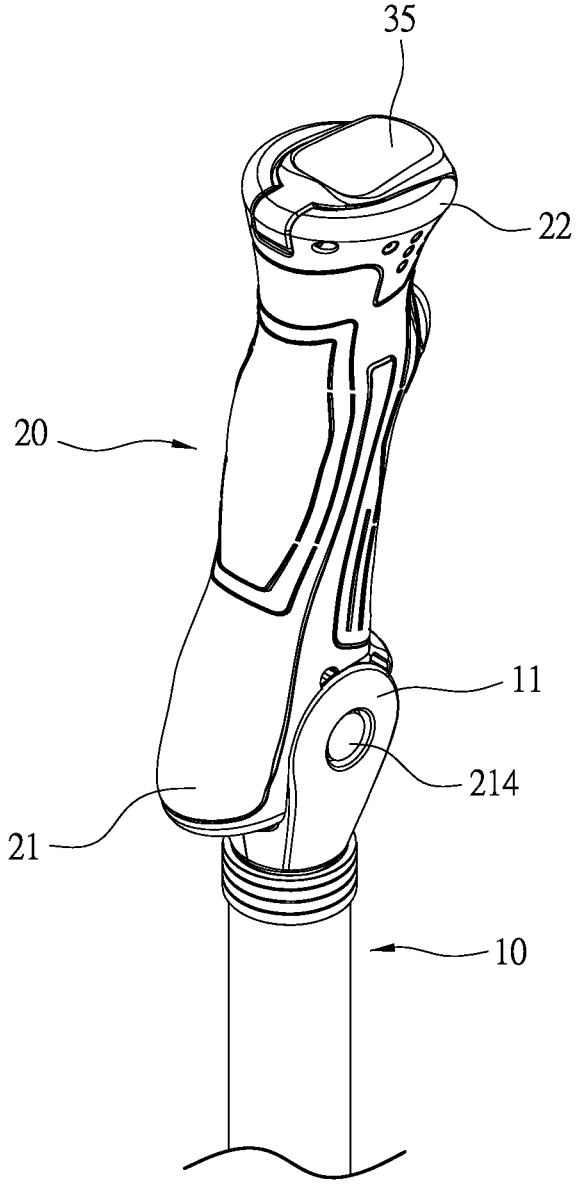
FIG. 8 is a three-dimensional view showing after angle adjustment according to the preferred embodiment of the present invention.

The actual use state of its structure can be seen from FIGS. 1, 3, and 4. The switching groove 213 of the handle member 20 faces the first positioning slot 111 and the spring 34 pushes the switching rod 30 to insert the plug 35 into the first positioning slot 111 along the switching groove 213 to form an engagement. At the same time, the handle member 20 and the connecting joint 10 are perpendicular with each other, and the handle member 20 is parallel to the ground which forms a walking assistance device, so that the user can hold the handle member 20.

The handle member 20 also can rotate around the shaft pin 214 to adjust the angle of the handle member 20. As shown in FIGS. 5 to 8, the cover 25 is pulled back, and the switching rod 30 is pulled toward the second end 22, so that the plug 35 of the first connecting end 31 of the switching rod 30 moves along the switching groove 213 and disengages from the first positioning slot 111. Meanwhile, the handle member 20 and the two trunnions 11 disengage from each other, so the handle member 20 rotate around the shaft pin 214 upward to release the cover 25, and the rebound force of the spring 34 pushes the switching rod 30 back and then moves along the edges of the two trunnions 11. When the switching groove 213 faces the second positioning slot 112, the plug 35 is pushed by the spring 34 to insert into the second positioning slot 112 and move along the switching groove 213 to form an engagement. Meanwhile, the handle member 20 extends upward perpendicular to the ground to form a trekking pole which allows the user to perpendicularly grab the handle member 20 for assist walking when hiking, which reduces the burden on the knees, soreness and sports injuries.

With the structure of the above specific embodiment, the following benefits can be obtained: the handle member 20 is rotatably installed between the connecting joint 10 and the two trunnions 11, and the switching rod 30 and the first and second positioning slots 111, 112 of the two trunnions 11 are designed to achieve the positioning state of the handle member 20 after swinging, so that the connecting joint 10 can adjust the angle of the handle member 20 so as to be general canes of trekking poles, which greatly improves the practicality and convenience of the structure, while saving the cost of purchasing different walking assistance devices.

Although the present invention has been explained in relation to its preferred embodiment, it is to be understood that many other possible modifications and variations can be made without departing from the spirit and scope of invention as hereinafter claimed.

What is claimed is:

1. A handle for a walking assistance device comprising:

a connecting joint with an end having a pair of trunnions, the two trunnions both respectively having an axial hole and a first positioning slot and a second positioning slot;

a handle member having a first end, a second end and a chamber in between the first end and the second end, the first end having an axial aperture and a switching groove and mounted between the two trunnions, a shaft pin connecting the axial hole and the axial aperture such that the first end is capable of rotating around the shaft pin; the switching groove is disposed to face one of the first and second positioning slots; the second end having a rotatable cover with an assembling portion, and the chamber having an annular divider adjacent to the second end;

a switching rod having a first connecting end and a second connecting end, and a stopping block between the first and second connecting ends; the second connecting end jacketed with a spring and insertable into the chamber from the first end of the handle member; the second connecting end passing through the annular divider and connected to the assembling portion of the cover, the second connecting end limiting the spring between the annular divider and the stopping block; the first connecting end facing the switching groove and connected to the first connecting end by utilizing a plug inserted through the switching groove, such that the switching rod controls movement of the plug along the switching groove via movement of the cover.

2. The handle for a walking assistance device as claimed in claim 1, wherein the first end of the handle member further comprises two matching recesses opposite to each other and corresponding to the two trunnions.

3. The handle for a walking assistance device as claimed in claim 1, wherein the second end of the handle member further comprises a pivoting recess disposed at an edge of the chamber; the cover further comprises a pivoting protrusion at one end configured for engagement with the pivoting recess and secured together by a shaft.

4. The handle for a walking assistance device as claimed in claim 1, wherein the first end of the handle member further comprises a tube plug inserted into the chamber, and the tube plug further comprises a through aperture capable of being aligned with the axial aperture and secured by the shaft pin.

* * * * *